US010901345B2

(12) United States Patent
Geshi

(10) Patent No.: US 10,901,345 B2
(45) Date of Patent: Jan. 26, 2021

(54) IMAGE FORMING APPARATUS AND IMAGE FORMING METHOD FOR CONTROLLING SHEET CONVEYANCE

(71) Applicant: KYOCERA Document Solutions Inc., Osaka (JP)

(72) Inventor: Takuya Geshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/705,889

(22) Filed: Dec. 6, 2019

(65) Prior Publication Data

US 2020/0192249 A1 Jun. 18, 2020

(30) Foreign Application Priority Data

Dec. 12, 2018 (JP) ..... 2018-232568

(51) Int. Cl.
*G03G 15/00* (2006.01)
*G03G 15/16* (2006.01)

(52) U.S. Cl.
CPC ..... *G03G 15/161* (2013.01); *G03G 15/5062* (2013.01); *G03G 15/6558* (2013.01); *G03G 15/6564* (2013.01)

(58) Field of Classification Search
CPC ..... G03G 15/6558; G03G 15/6561; G03G 15/6564
USPC ..... 399/388, 394, 396
See application file for complete search history.

(56) References Cited

U.S. PATENT DOCUMENTS 9,651,912 B2 * 5/2017 Onishi ..... G03G 15/6564
10,035,673 B2 * 7/2018 Tani ..... G03G 15/6564

FOREIGN PATENT DOCUMENTS

JP 2009161296 A 7/2009

* cited by examiner

*Primary Examiner* — William J Royer
(74) *Attorney, Agent, or Firm* — Studebaker & Brackett PC

(57) ABSTRACT

An image forming apparatus includes a sheet feed section, a sheet feed roller, an intermediate roller pair, an intermediate sensor, and a controller. The intermediate roller pair is provided downstream of the sheet feed roller in a conveyance direction and conveys a sheet downstream of the conveyance direction. The intermediate sensor is provided upstream of the intermediate roller pair in the conveyance direction and detects the sheet conveyed to the intermediate roller pair. The sheet feed roller feeds a leading sheet and feeds a following sheet just after the leading sheet. The controller calculates a first interval between a trailing edge of the leading sheet and a leading edge of the following sheet based on an output of the intermediate sensor. According to the first interval, the controller performs control so that the sheet feed roller and the intermediate roller pair are driven.

7 Claims, 7 Drawing Sheets

IMAGE FORMING APPARATUS AND IMAGE FORMING METHOD FOR CONTROLLING SHEET CONVEYANCE

INCORPORATION BY REFERENCE

The present application claims priority under 35 U.S.C. § 119 to Japanese Patent Application No. 2018-232568, filed on Dec. 12, 2018. The contents of this application are incorporated herein by reference in their entirety.

BACKGROUND

The present disclosure relates to an image forming apparatus and an image forming method.

An image forming apparatus causes a sheet feed roller to send out a sheet from a sheet feed section to a conveyance path. Conveyance timing of the sheet is subsequently adjusted by a registration roller, and then the sheet is conveyed to a secondary transfer roller. Driving force of a sheet feed motor is transmitted to the sheet feed roller via a solenoid. The sheet feed motor rotates at a constant speed.

SUMMARY

An image forming apparatus according to an aspect of the present disclosure conveys sheets in a conveyance direction along a conveyance path to form an image on each of the sheets. The image forming apparatus includes a sheet feed section, a sheet feed roller, an intermediate roller pair, an intermediate sensor, and a controller. The sheet feed section allows the sheets to be loaded therein. The sheet feed roller feeds each of the sheets from the sheet feed section to the conveyance path. The intermediate roller pair is provided downstream of the sheet feed roller in the conveyance direction. Each of the sheets is conveyed downstream of the conveyance direction by the intermediate roller pair. The intermediate sensor is provided upstream of the intermediate roller pair in the conveyance direction. The intermediate sensor detects each of the sheets conveyed to the intermediate roller pair. The controller performs control so that the sheet feed roller and the intermediate roller pair are driven. The sheets include a leading sheet and a following sheet. The sheet feed roller feeds the leading sheet and feeds the following sheet just after the leading sheet. The controller calculates a first interval between a trailing edge of the leading sheet and a leading edge of the following sheet based on an output of the intermediate sensor. According to the first interval, the controller performs control so that the sheet feed roller and the intermediate roller pair are driven.

An image forming method according to an aspect of the present disclosure includes causing a sheet feed roller to feed a leading sheet to a conveyance path and subsequently causing the sheet feed roller to feed a following sheet to the conveyance path, calculating a first interval between a trailing edge of the leading sheet conveyed by an intermediate roller pair and a leading edge of the following sheet conveyed to the intermediate roller pair just after the leading sheet, and performing control, according to the first interval, so that the sheet feed roller and the intermediate roller pair are driven.

DETAILED DESCRIPTION

Figure 1:
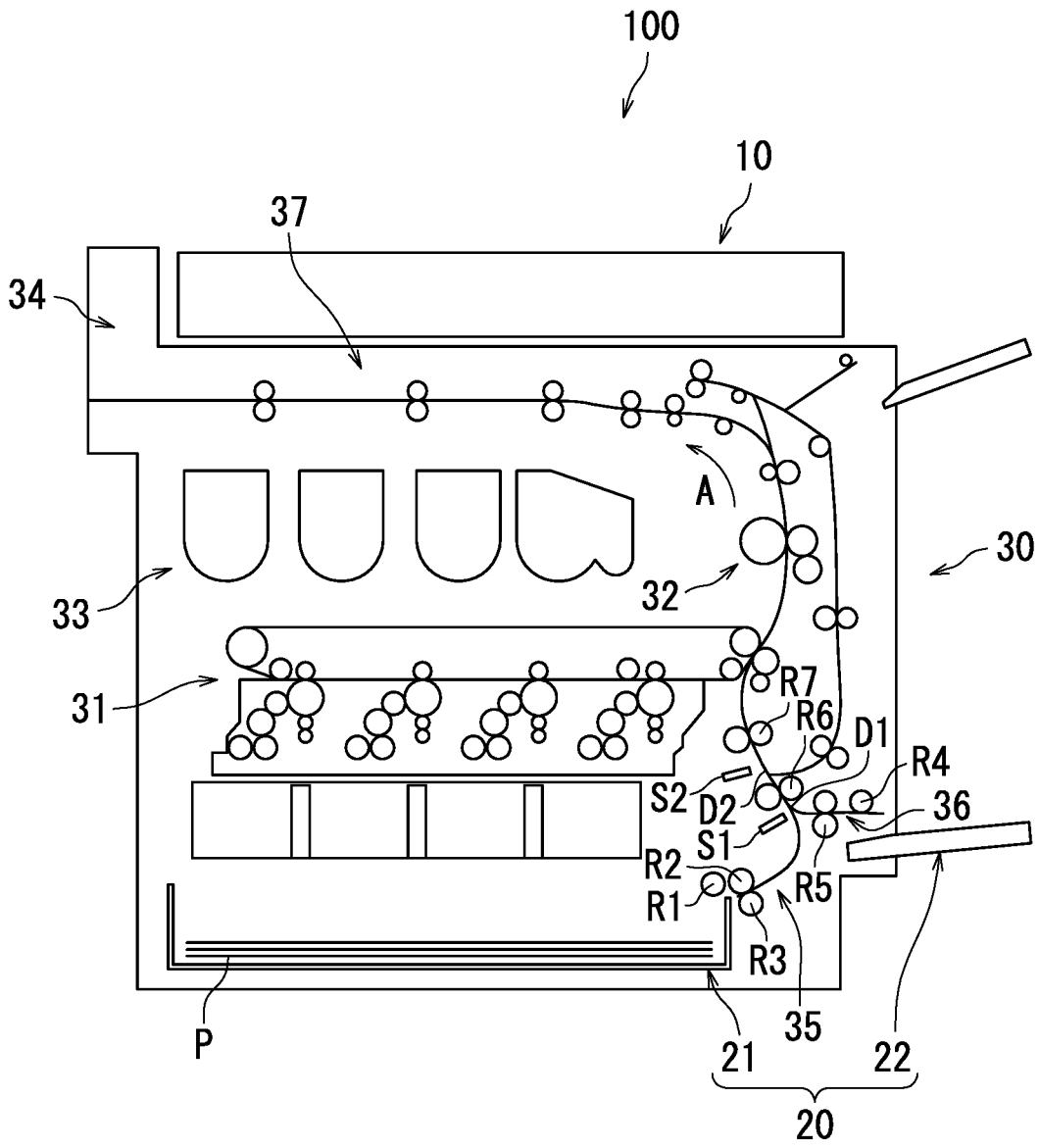
FIG. 1 illustrates an image forming apparatus according to an embodiment of the present disclosure.

An embodiment of the present disclosure will hereinafter be described with reference to the accompanying drawings. Elements that are the same or equivalent are labelled with the same reference signs in the drawings and description thereof is not repeated.

An image forming apparatus 100 according to the present embodiment will be described with reference to FIG. 1. FIG. 1 illustrates the image forming apparatus 100 according to the embodiment of the present disclosure.

The image forming apparatus 100 is a multifunction peripheral.

As illustrated in FIG. 1, the image forming apparatus 100 individually conveys sheets P in a conveyance direction A and forms an image on each sheet P. The image forming apparatus 100 includes an image reading section 10, a sheet feed section 20, an image forming section 30, a first sheet feed roller R1, a feed roller R2, a retard roller R3, a second sheet feed roller R4, a manual feed roller pair R5, an intermediate roller pair R6, a registration roller pair R7, an intermediate sensor S1, and a registration sensor S2. The image forming apparatus 100 also has a conveyance path. The conveyance path has a first conveyance path 35, a second conveyance path 36, and a third conveyance path 37. The first sheet feed roller R1, the feed roller R2, the retard roller R3, the second sheet feed roller R4, the manual feed roller pair R5, the intermediate roller pair R6, and the registration roller pair R7 may hereinafter be referred collectively to as a "roller group".

The image reading section 10 scans an image produced on a document sheet to capture image data.

The sheet feed section 20 allows the sheets P for printing to be loaded therein. The sheet feed section 20 has a sheet feed cassette 21 and a manual feed tray 22.

Each of the sheets P loaded in the sheet feed cassette 21 is fed from the sheet feed cassette 21 to the first conveyance path 35. One or more sheets P loaded on the manual feed tray 22 are individually fed from the manual feed tray 22 to the second conveyance path 36. The first conveyance path 35 and the second conveyance path 36 meet upstream from a first detection point D1. The first detection point D1 is a point at which the intermediate sensor S1 detects presence or absence of a sheet P. Of the conveyance path, the third conveyance path 37 is part located downstream of a point where the first conveyance path 35 and the second conveyance path 36 meet.

The roller group conveys each of the sheets P loaded in the sheet feed section 20 to the image forming section 30. The first sheet feed roller R1, the feed roller R2, and the retard roller R3 are disposed in the first conveyance path 35 from an upstream side thereof in that order. The second sheet feed roller R4 and the manual feed roller pair R5 are disposed in the second conveyance path 36 from an upstream side thereof in that order. The intermediate roller pair R6 and the registration roller pair R7 are disposed in the third conveyance path 37 from an upstream side thereof in that order.

Each of the sheets P loaded in the sheet feed cassette 21 is conveyed by the first sheet feed roller R1 from the sheet feed cassette 21 to the first conveyance path 35. Specifically, the first sheet feed roller R1 rotates, thereby sequentially feeding the sheets P loaded in the sheet feed cassette 21. Hereinafter, a sheet P fed first is referred to as a "leading sheet P2", and a sheet P fed just after the leading sheet P2 is referred to as a "following sheet P1". That is, the first sheet feed roller R1 feeds the leading sheet P2 to the first conveyance path 35. The first sheet feed roller R1 subsequently feeds the following sheet P1 to the first conveyance path 35. The first sheet feed roller R1 is provided for the sheet feed cassette 21.

The feed roller R2 and the retard roller R3 convey the sheet P fed by the first sheet feed roller R1 toward the intermediate roller pair R6. The feed roller R2 and the retard roller R3 are opposite each other and are pressed against each other. The feed roller R2 rotates, thereby sending out the sheet P in the conveyance direction A. When receiving incoming one sheet P, the retard roller R3 rotates following the rotation of the feed roller R2 that is sending the sheet P being fed by the first sheet feed roller R1. In contrast, when receiving incoming one sheet P along with one or more different sheets P, the retard roller R3 stops or rotates in a direction opposite to a direction in which the one sheet P is to be sent, thereby separating the one or more different sheets P from the one sheet P in contact with the feed roller R2. The feed roller R2 consequently sends out the one sheet P.

The second sheet feed roller R4 feeds one or more sheets P loaded on the manual feed tray 22 to second conveyance path 36. Specifically, the second sheet feed roller R4 rotates, thereby feeding a leading sheet P2 to the second conveyance path 36. The second sheet feed roller R4 sequentially feeds a following sheet P1 just after the leading sheet P2 to the second conveyance path 36. The second sheet feed roller R4 is provided for the manual feed tray 22. The second sheet feed roller R4 is also connected with an encoder. The encoder outputs pulses according to rotational displacement of the second sheet feed roller R4.

The manual feed roller pair R5 individually conveys the sheets P fed by second sheet feed roller R4 one each toward the intermediate roller pair R6.

Each sheet P sent out from the sheet feed section 20 is conveyed downstream of the conveyance direction A by the intermediate roller pair R6. The intermediate roller pair R6 is provided downstream of the first sheet feed roller R1 and the second sheet feed roller R4 in the conveyance direction A.

The registration roller pair R7 serves to adjust timing at which each sheet P is conveyed to the image forming section 30. The registration roller pair R7 is provided upstream of the image forming section 30 in the conveyance direction A.

The image forming section 30 forms an image on each sheet P. The image forming section 30 has an imaging section 31, a fixing device 32, a toner replenishment device 33, and a sheet ejecting section 34.

The imaging section 31 forms a toner image on each sheet P. Toner to form the toner image is replenished from the toner replenishment device 33 to the imaging section 31. The fixing device 32 heats and pressurizes the sheet P, thereby melting and fixing the toner image which is unfixed and formed by the imaging section 31 to the sheet P. The sheet ejecting section 34 ejects the sheet P that has passed through the imaging section 31 and the fixing device 32.

The intermediate sensor S1 detects presence or absence of the sheet P at the first detection point D1. The intermediate sensor S1 is provided downstream of the first and second sheet feed rollers R1 and R4 and upstream of the intermediate roller pair R6 in the conveyance direction A. Specifically, the intermediate sensor S1 is provided between the intermediate roller pair R6 and both of the feed roller R2 and the retard roller R3. The intermediate sensor S1 is provided between the manual feed roller pair R5 and the intermediate roller pair R6. The intermediate sensor S1 is for example an optical reflective sensor. Specifically, the intermediate sensor S1 emits light and detects presence or absence of the sheet P based on presence or absence of reflected light.

The registration sensor S2 detects presence or absence of the sheet P at a second detection point D2. The registration sensor S2 is provided upstream of the registration roller pair R7 and downstream of the intermediate roller pair R6 in the conveyance direction A. The registration sensor S2 is for example an optical reflective sensor.

Hereinafter, the image forming apparatus 100 according to the present embodiment will further be described with reference to FIGS. 2 and 3. Each of FIGS. 2 and 3 is a block diagram of the image forming apparatus 100 according to the present embodiment.

Figure 2:
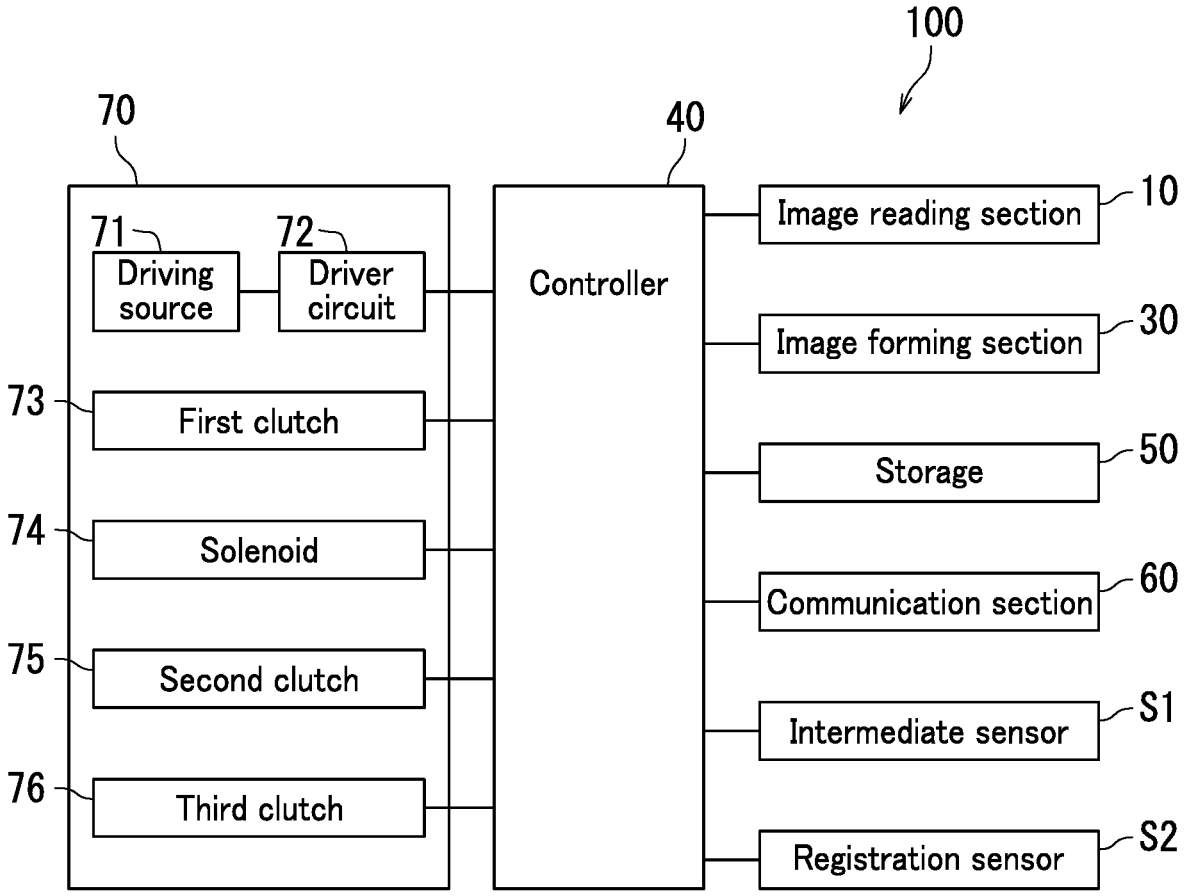
FIG. 2 is a block diagram of the image forming apparatus according to the embodiment of the present disclosure.
Figure 3:
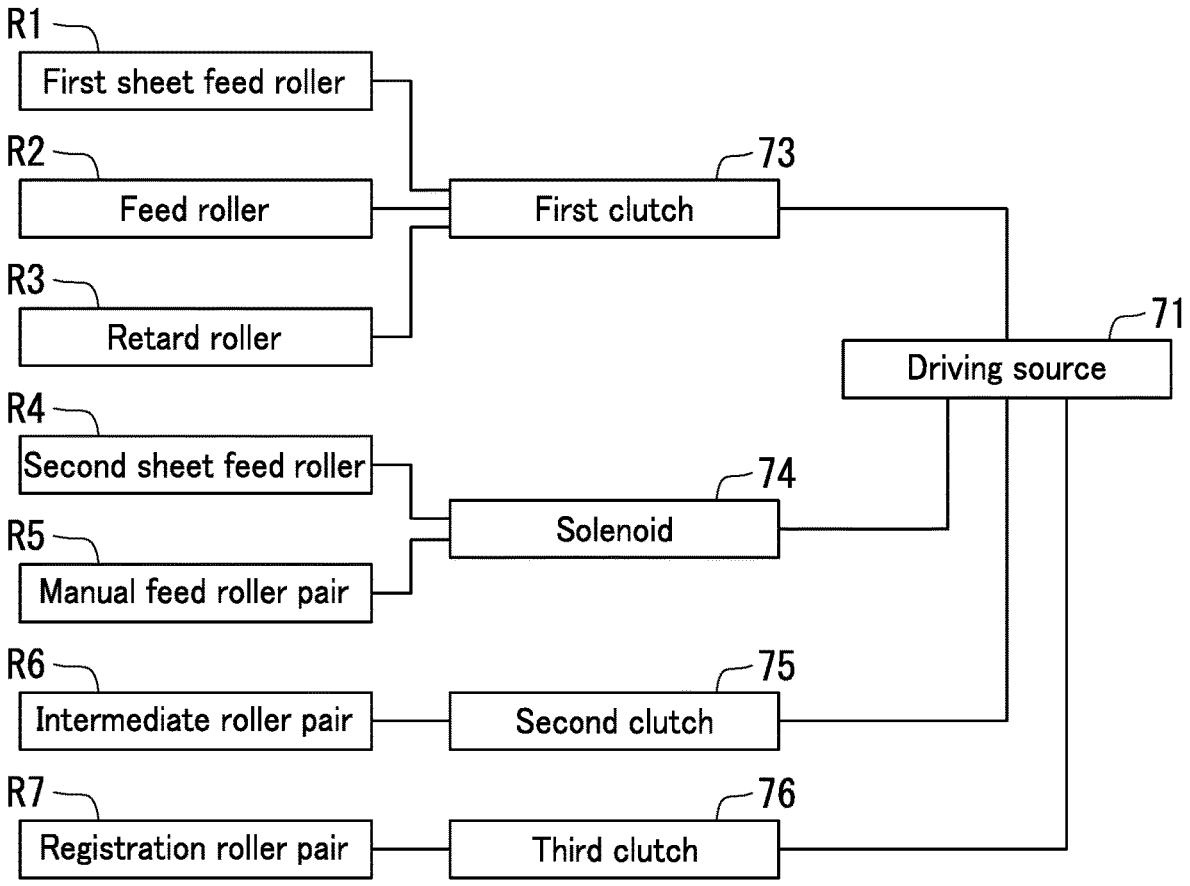
FIG. 3 is a block diagram of the image forming apparatus according to the embodiment of the present disclosure.

As illustrated in FIG. 2, the image forming apparatus 100 further includes a controller 40, storage 50, a communication section 60, and a roller drive section 70.

The controller 40 is a hardware circuit including a processor such as a central processing unit (CPU). The controller 40 executes a control program stored in the storage 50, thereby controlling respective operations of components constituting the image forming apparatus 100. Based on a signal transmitted from the intermediate sensor S1 and a signal transmitted from the registration sensor S2, the controller 40 performs control so that the roller group is driven. The controller 40 counts pulses transmitted from an encoder, and detects an end of rotation of the second sheet feed roller R4.

The storage 50 stores therein various pieces of data. The storage 50 includes main memory such as semiconductor memory, and an auxiliary storage device such as a hard disk drive. The main memory includes read-only memory (ROM) and random-access memory (RAM). The storage 50 stores therein different computer programs to be executed by the controller 40. The different computer programs include firmware and the control program. The storage 50 stores therein interval information. The interval information represents a predefined second interval B2. The second interval B2 represents a threshold of a sheet interval between the leading sheet P2 and the following sheet P1. The sheet interval represents a distance between a trailing edge of the leading sheet P2 and a leading edge of the following sheet P1. A paper jam is less likely to occur if the sheet interval between the leading sheet P2 and the following sheet P1 is greater than or equal to the second interval B2. The sheet interval between the following sheet P1 and the leading sheet P2 being closer to the second interval B2 enables an increase in the number of prints per unit time. The second interval B2 is appropriately adjusted according to each component of the image forming apparatus 100, the control program, and a type of the sheets P.

The communication section 60 allows mutual communication with an external terminal via a network. The communication section 60 receives a print instruction transmitted from the external terminal. Examples of the network include a local area network (LAN), the Internet, and a telephone network. The communication section 60 is for example a LAN adapter.

The roller drive section 70 has a driving source 71, a driver circuit 72, a first clutch 73, a solenoid 74, a second clutch 75, and a third clutch 76. The controller 40 controls the driver circuit 72, thereby causing the driving source 71 to generate driving force for rotating the roller group. The driving source 71 is for example a DC motor.

The driving source 71 is connected to the driver circuit 72. The controller 40 controls respective operations of the driver circuit 72, the first clutch 73, the solenoid 74, the second clutch 75, and the third clutch 76.

As illustrated in FIG. 3, an output (motor output shaft) of the driving source 71 is connectable to the first sheet feed roller R1, the feed roller R2, and the retard roller R3 via the first clutch 73. The output of the driving source 71 is also connectable to the second sheet feed roller R4 and the manual feed roller pair R5 via the solenoid 74. The output of the driving source 71 is also connectable to the intermediate roller pair R6 via the second clutch 75. The output of the driving source 71 is also connectable to the registration roller pair R7 via the third clutch 76. That is, the roller group is driven by the single driving source 71. The first sheet feed roller R1, the feed roller R2, and the retard roller R3 may hereinafter be referred collectively to as a "first sheet feed roller group". The second sheet feed roller R4 and the manual feed roller pair R5 may also be referred to as a "second sheet feed roller group".

The controller 40 causes the first clutch 73 to switch between a connecting state and a disconnecting state. The first clutch 73 in the connecting state allows the driving source 71 to transmit the driving force thereof to the first sheet feed roller group. The first sheet feed roller group is therefore driven in the connecting state of the first clutch 73. The first clutch 73 in the disconnecting state prohibits the driving source 71 from transmitting the driving force thereof to the first sheet feed roller group. The first sheet feed roller group is therefore stopped in the disconnecting state of the first clutch 73. In the present embodiment, the first clutch 73 is an electromagnetic clutch having a spring and a shaft. When the first clutch 73 is energized, the spring in the electromagnetic clutch winds around the shaft. The first clutch 73 consequently enters a connecting state. When the first clutch 73 is not energized, the winding of the spring in the electromagnetic clutch around the shaft is released. The first clutch 73 consequently enters a disconnecting state. The controller 40 energizes the first clutch 73 for a predetermined period every time a sheet P is fed from the sheet feed cassette 21. The predetermined period is a period of time that allows the sheet P to be fed to the first conveyance path 35.

In the present embodiment, the first clutch 73 allows and prohibits transmission of driving force to the first sheet feed roller group. The first clutch 73 is therefore switched to the disconnecting state responsive to control by the controller 40, thereby quickly blocking the transmission of the driving force to the first sheet feed roller group. Note that although the electromagnetic clutch having the spring is used in the present embodiment, the first clutch 73 is not limited to this. Examples of the first clutch 73 may include an electromagnetic friction clutch and an engagement electromagnetic clutch.

The controller 40 causes the solenoid 74 to switch between a connecting state and a disconnecting state. The solenoid 74 in the connecting state allows the driving source 71 to transmit the driving force thereof to the second sheet feed roller group. The second sheet feed roller group is therefore driven in the connecting state of the solenoid 74. The solenoid 74 in the disconnecting state prohibits the driving source 71 from transmitting the driving force thereof to the second sheet feed roller group. The second sheet feed roller group is therefore stopped in the disconnecting state of the solenoid 74. In the present embodiment, the solenoid 74 has a flapper type solenoid and a first gear. The flapper type solenoid has a spring member. The second sheet feed roller R4 has a second gear. The manual feed roller pair R5 has a third gear. Teeth of the first gear engages with teeth of the second gear and teeth of the third gear. When the solenoid 74 is energized, the flapper type solenoid is separated from the teeth of the first gear to enter the disconnecting state. When the solenoid 74 is not energized, the flapper type solenoid is engaged with the teeth of the first gear by action of the spring member. The solenoid 74 consequently enters the connecting state via the first gear. The controller 40 de-energizes the solenoid 74 for a predetermined period every time a sheet P is fed from the manual feed tray 22. The predetermined period is a period of time that allows the sheet P to be fed to the second conveyance path 36.

The solenoid 74 includes the flapper type solenoid. This causes the solenoid 74 after being energized to enter the disconnecting state when the predetermined period has elapsed. That is, the solenoid 74 has a long response time. The solenoid 74 consequently enters the disconnecting state after a lapse of the response time since the start of the energization.

The controller 40 causes the second clutch 75 to switch between a connecting state and a disconnecting state. The second clutch 75 in the connecting state allows the driving source 71 to transmit the driving force thereof to the intermediate roller pair R6. The intermediate roller pair R6 is therefore driven in the connecting state of the second clutch 75. The second clutch 75 in the disconnecting state prohibits the driving source 71 from transmitting the driving force thereof to the intermediate roller pair R6. The intermediate roller pair R6 is therefore stopped in the disconnecting state of the second clutch 75. In the present embodiment, the second clutch 75 is an electromagnetic clutch having a spring. The controller 40 controls the second clutch 75 so that the intermediate roller pair R6 stops every time a sheet P passes through the intermediate roller pair R6. Note that the second clutch 75 is not limited to the electromagnetic clutch having the spring. Examples of the second clutch 75 may include an electromagnetic friction clutch and an engagement electromagnetic clutch.

The controller 40 causes the third clutch 76 to switch between a connecting state and a disconnecting state. The third clutch 76 in the connecting state allows the driving source 71 to transmit the driving force thereof to the registration roller pair R7. The registration roller pair R7 is therefore driven in the connecting state of the third clutch 76. The third clutch 76 in the disconnecting state prohibits the driving source 71 from transmitting the driving force thereof to the registration roller pair R7. The registration roller pair R7 is therefore stopped in the disconnecting state of the third clutch 76. In the present embodiment, the third clutch 76 is an electromagnetic clutch having a spring. Note that the third clutch 76 is not limited to the electromagnetic clutch having the spring. Examples of the third clutch 76 may include an electromagnetic friction clutch and an engagement electromagnetic clutch.

Figure 4:
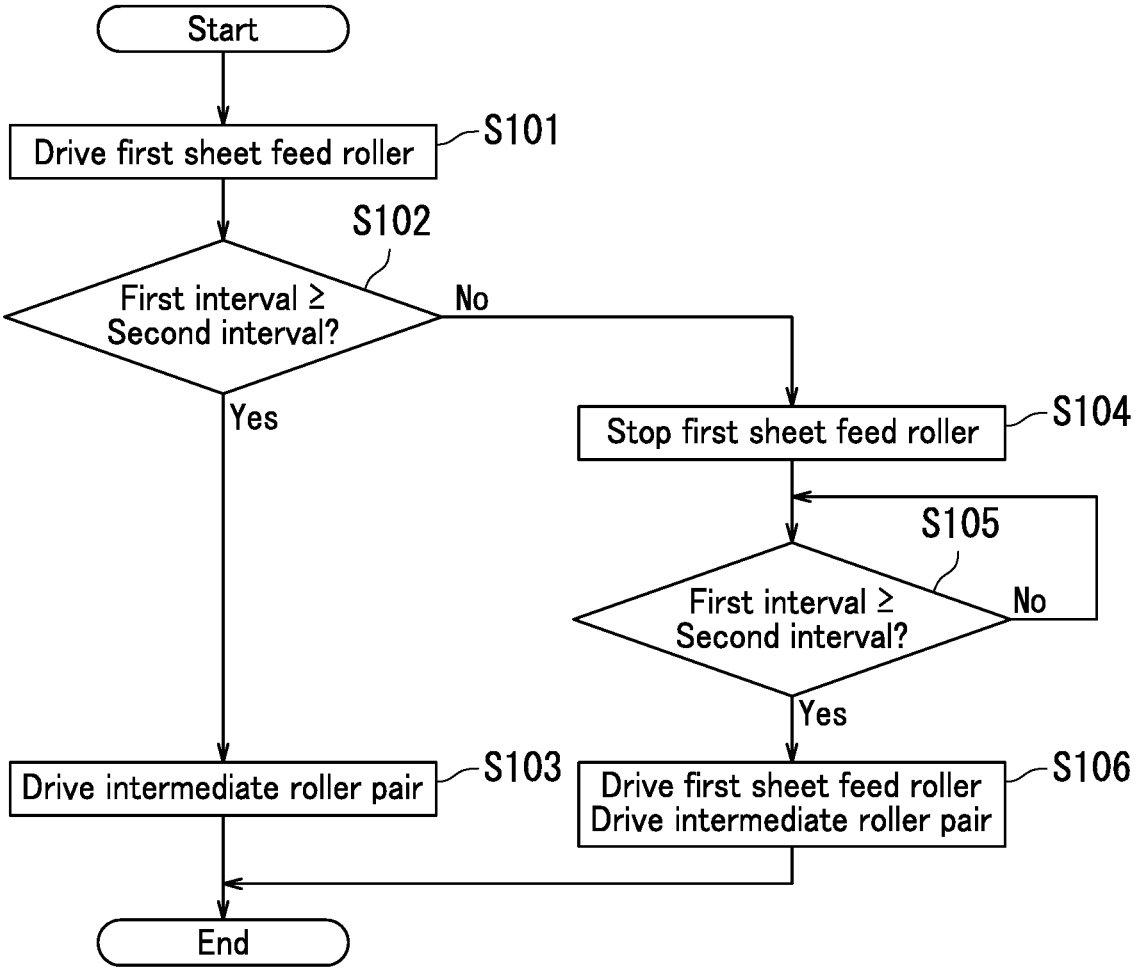
FIG. 4 is a flowchart depicting a process executed by a controller according to the embodiment of the present disclosure.

A process executed by the controller 40 will next be described with reference to FIGS. 1 to 4. FIG. 4 is a flowchart depicting the process to be executed by the controller 40 of the image forming apparatus 100 according to the present embodiment. Specifically, a leading sheet P2 is fed from the sheet feed cassette 21 to the first conveyance path 35. According to this, the process depicted in FIG. 4 starts. In addition, at a point in time when the process starts, the first sheet feed roller R1, the feed roller R2, and the retard roller R3 are stopped.

The controller 40 controls the second clutch 75 so that the intermediate roller pair R6 is stopped every time a sheet P passes through the intermediate roller pair R6. The controller 40 also controls the third clutch 76 so that the registration roller pair R7 is driven during a period between reception of a print instruction by the controller 40 and completion of a process of the print instruction by the controller 40.

Step S101: the controller 40 performs control so that the first sheet feed roller R1 is driven. Specifically, the controller 40 causes the first clutch 73 to switch to the connecting state. The driving force of the driving source 71 is therefore transmitted to the first sheet feed roller R1, the feed roller R2, and the retard roller R3. The first sheet feed roller R1, the feed roller R2, and the retard roller R3 are consequently driven. The first sheet feed roller R1, the feed roller R2, and the retard roller R3 are driven, thereby conveying a following sheet P1 toward the intermediate roller pair R6. When the leading edge of the following sheet P1 reaches the first detection point D1, the process proceeds to Step S102.

Step S102: the controller 40 calculates a first interval B1 based on an output (signal) of the intermediate sensor S1. Specifically, the first interval B1 based on the output of the intermediate sensor S1 is calculated based on a conveyance speed of the leading sheet P2 and a period between detection of the trailing edge of the leading sheet P2 by the intermediate sensor S1 and detection of the leading edge of the following sheet P1 by the intermediate sensor S1. The first interval B1 represents a distance between the trailing edge of the leading sheet P2 and the leading edge of the following sheet P1. The controller 40 determines whether or not the first interval B1 is greater than or equal to the predefined second interval B2. When the controller 40 determines that the first interval B1 based on the output of the intermediate sensor S1 is greater than or equal to the second interval B2 (Step S102; Yes), the process proceeds to Step S103. When the controller 40 determines that the first interval B1 based on the output of the intermediate sensor S1 is not greater than or equal to the second interval B2 (Step S102; No), the process proceeds to Step S104.

Step S103: the controller 40 performs control so that the intermediate roller pair R6 is driven. Specifically, the controller 40 causes the second clutch 75 to switch to the connecting state. The driving force of the driving source 71 is therefore transmitted to the intermediate roller pair R6. The intermediate roller pair R6 is consequently driven. The intermediate roller pair R6 is driven, thereby conveying the following sheet P1 toward the registration roller pair R7. The process then ends.

Step S104: the controller 40 performs control so that the first sheet feed roller R1 is stopped. Specifically, the controller 40 causes the first clutch 73 to switch to the disconnecting state. The driving force of the driving source 71 is therefore not transmitted to the first sheet feed roller R1, the feed roller R2, and the retard roller R3. The first sheet feed roller R1, the feed roller R2, and the retard roller R3 are consequently stopped. The first sheet feed roller R1, the feed roller R2, and the retard roller R3 are stopped, thereby stopping conveyance of the following sheet P1. That is, while the conveyance of the following sheet P1 is being stopped, the leading sheet P2 is being conveyed, thereby increasing the first interval B1. The process then proceeds to Step S105.

Step S105: the controller 40 calculates the first interval B1, and determines whether or not the first interval B1 is greater than or equal to the second interval B2. The first interval B1 at Step S105 is calculated based on first control data. The first control data contains a first period and a conveyance speed of the leading sheet P2. The first period represents an elapsed period since stopping of the first sheet feed roller group. When the controller 40 determines that the first interval B1 based on the first control data is greater than or equal to the second interval B2 (Step S105; Yes), the process proceeds to Step S106. When the controller 40 determines that the first interval B1 based on the first control data is not greater than or equal to the second interval B2 (Step S105; No), the process returns to Step S105. That is, when the controller 40 determines that the first interval B1 based on the first control data is not greater than or equal to the second interval B2, the conveyance of the following sheet P1 remains stopped until the controller 40 determines that the first interval B1 based on the first control data is greater than or equal to the second interval B2.

Step S106: the controller 40 performs control so that the first sheet feed roller group and the intermediate roller pair R6 are driven. The controller 40 performs control so that the first sheet feed roller group is driven, thereby conveying the following sheet P1 to the intermediate roller pair R6. The controller 40 also performs control so that the intermediate roller pair R6 is driven, thereby conveying the following sheet P1 to the registration roller pair R7. The process then ends.

Hereinafter, the process executed by the controller 40 will further be described with reference to FIGS. 1, 2, 3, 5A and 5B. Each of FIGS. 5A and 5B is a schematic diagram depicting how each sheet P is conveyed from the sheet feed cassette 21 in the present embodiment.

Figure 5A:
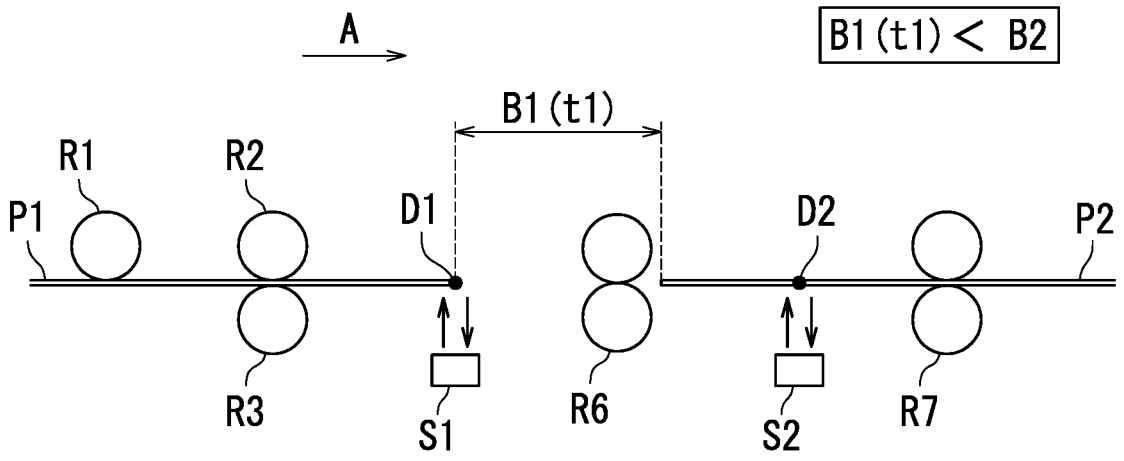
FIGS. 5A and 5B are schematic diagrams depicting how sheets are conveyed from a sheet feed cassette according to the embodiment of the present disclosure.
Figure 5B:
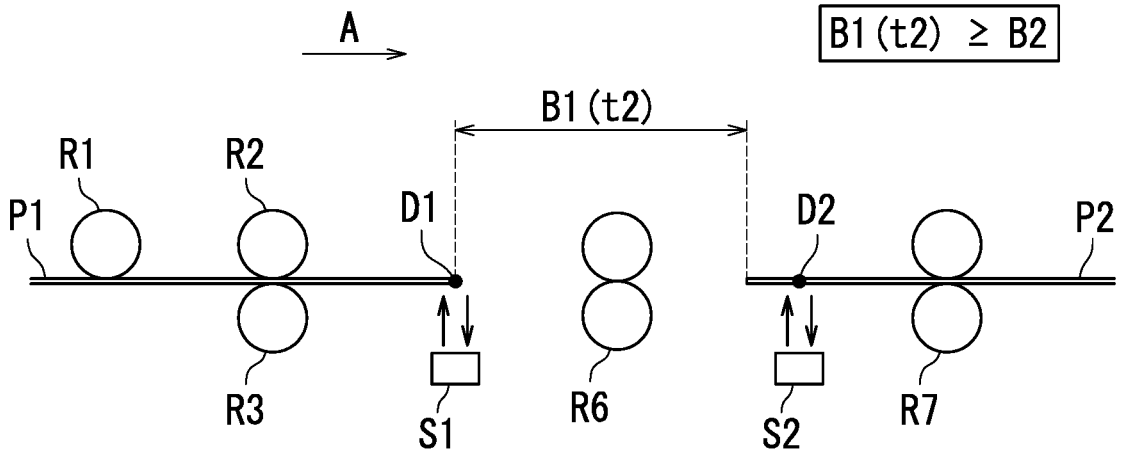

Specifically, FIG. 5A depicts a conveyance state of the following sheet P1 and the leading sheet P2 at time t1. Time t1 is stop time of the first sheet feed roller group by the control of the controller 40. In FIG. 5A, a first interval B1(t1) represents a first interval B1 based on an output of the intermediate sensor S1 at time t1.

As illustrated in FIG. 5A, the controller 40 determines that the first interval B1(t1) calculated based on the output of the intermediate sensor S1 is not greater than or equal to the second interval B2, and then performs control so that the first sheet feed roller group is stopped. At time t1, the conveyance of the following sheet P1 is stopped, while the leading sheet P2 is conveyed in the conveyance direction A.

Drive of the first sheet feed roller group is also controlled by the controller 40 through the first clutch 73. The first clutch 73 is therefore switched to the disconnecting state responsive to the control by the controller 40, thereby quickly stopping the first sheet feed roller R1, the feed roller R2, and the retard roller R3. The leading edge of the following sheet P1 is consequently positioned adjacent to the first detection point D1.

FIG. 5B depicts a conveyance state of the following sheet P1 and the leading sheet P2 at time t2. Time t2 represents start time of driving of the first sheet feed roller R1 and the intermediate roller pair R6 by the controller 40 after time t1.

In FIG. 5B, a first interval B1(t2) represents a first interval B1 based on the first control data at time t2.

As illustrated in FIG. 5B, the controller 40 determines that the first interval B1(t2) calculated based on the first control data is greater than or equal to the second interval B2, and then starts drive control on the first sheet feed roller R1 and the intermediate roller pair R6. The following sheet P1 and the leading sheet P2 are consequently conveyed in the conveyance direction A.

As described above with reference to FIGS. 1 to 5A, and 5B, the controller 40 calculates the first interval B1 based on the output of the intermediate sensor S1. According to the first interval B1 calculated based on the output of the intermediate sensor S1, the controller 40 performs control so that the first sheet feed roller R1 and the intermediate roller pair R6 are driven. The sheet interval between the leading sheet P2 and the following sheet P1 is accordingly adjusted. The occurrence of the paper jam is consequently suppressed even if feed timing of the following sheet P1 from the sheet feed cassette 21 to the first conveyance path 35 is advanced in order to increase the number of prints per unit time. Specifically, the sheet interval between the leading sheet P2 and the following sheet P1 being not greater than or equal to the second interval B2 renders the controller 40 unable to distinguish the leading sheet P2 and the following sheet P1 based on the output of the registration sensor S2. This may cause the occurrence of the paper jam. In contrast, the present embodiment adjusts the sheet interval between the leading sheet P2 and the following sheet P1 before the following sheet P1 reaches the second detection point D2. This enables the controller 40 to distinguish the leading sheet P2 and the following sheet P1 based on the output of the registration sensor S2. The occurrence of the paper jam is accordingly suppressed.

The controller 40 determines that the first interval B1 based on the output of the intermediate sensor S1 is greater than or equal to the second interval B2, and thereby performs control so that the intermediate roller pair R6 is driven. That is, when the controller 40 determines that the first interval B1 based on the output of the intermediate sensor S1 is greater than or equal to the second interval B2, the first sheet feed roller group and the intermediate roller pair R6 convey the following sheet P1 to the registration roller pair R7 with the conveyance of the following sheet P1 by the first sheet feed roller group not stopped.

The controller 40 determines that the first interval B1 based the output of the intermediate sensor S1 is not greater than or equal to the second interval B2, thereby performing control so that drive of the first sheet feed roller group is temporarily stopped. The controller 40 then performs control so that the first sheet feed roller group and the intermediate roller pair R6 are driven. This enables the sheet interval between the leading sheet P2 and the following sheet P1 to be wider than that when the drive of the first sheet feed roller group is not stopped. The occurrence of the paper jam is consequently suppressed.

The controller 40 determines that the first interval B1 based on the output of the intermediate sensor S1 is not greater than or equal to the second interval B2, thereby performing control so that the drive of the first sheet feed roller group is temporarily stopped. The controller 40 subsequently performs control so that the first sheet feed roller R1 and the intermediate roller pair R6 are driven until the interval between the trailing edge of the leading sheet P2 and the leading edge of the following sheet P1 reaches at least the second interval B2. That is, the sheet interval between the leading sheet P2 and the following sheet P1 is adjusted to be greater than or equal to the second interval B2. The occurrence of the paper jam is therefore suppressed. This configuration also enables an increase in the number of prints per unit time by the image forming apparatus 100.

Figure 6:
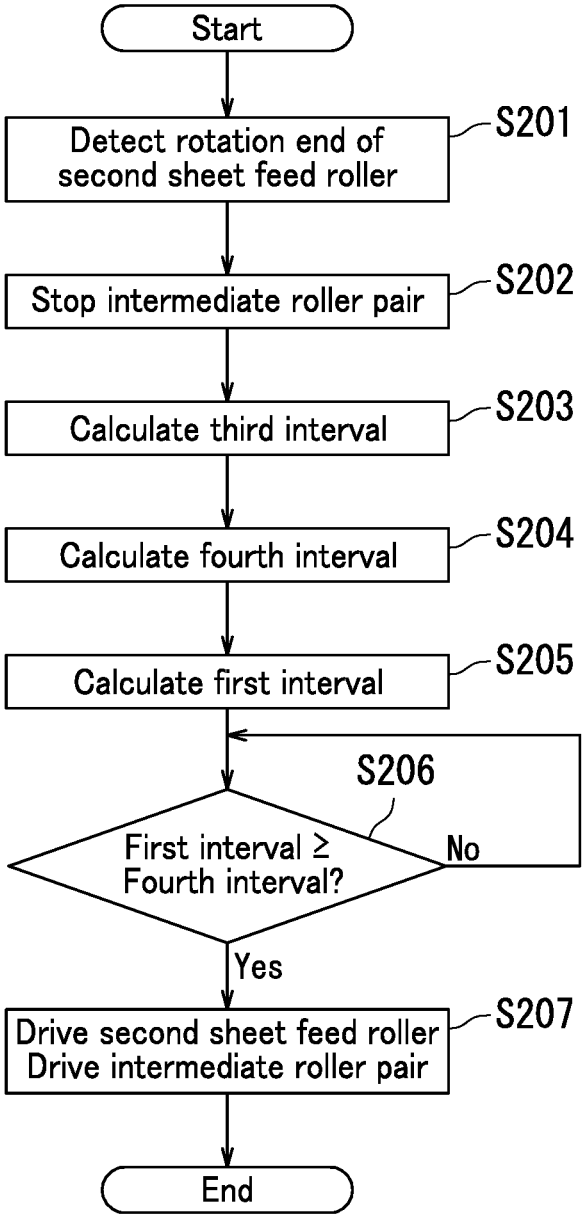
FIG. 6 is a flowchart depicting a process executed by the controller according to the embodiment of the present disclosure.

A process executed by the controller 40 will next be described with reference to FIGS. 1 to 3, and 6. FIG. 6 is a flowchart depicting the process to be executed by the controller 40 of the image forming apparatus 100 according to the present embodiment. Specifically, the process depicted in FIG. 6 starts according to control of the solenoid 74 by the controller 40. The control includes switching the solenoid 74 to the disconnecting state, and is performed after the following sheet P1 is fed to the second conveyance path 36.

Step S201: the controller 40 detects the end of rotation of the second sheet feed roller R4. In the present embodiment, when the second sheet feed roller R4 stops, the manual feed roller pair R5 also stops. The controller 40 detects the end of rotation of the second sheet feed roller R4 based on a signal transmitted from the encoder. The process then proceeds to Step S202.

Step S202: the controller 40 performs control so that the intermediate roller pair R6 is stopped. The intermediate roller pair R6 is stopped, thereby stopping the conveyance of the following sheet P1. The process then proceeds to Step S203.

Step S203: the controller 40 calculates a third interval B3. The third interval B3 represents a distance between the position of the leading edge of the following sheet P1 and the first detection point D1 of the intermediate sensor S1. Here, the leading edge of the following sheet P1 has passed the first detection point D1. The third interval B3 represents a distance caused by a long response time of the solenoid 74. The third interval B3 is calculated by second control data. The second control data contains for example the response time of the solenoid 74 and a conveyance speed of the leading sheet P2. The process then proceeds to Step S204.

Step S204: the controller 40 acquires a fourth interval B4 by subtracting the third interval B3 from the second interval B2. The process then proceeds to Step S205.

Step S205: the controller 40 calculates a first interval B1. The first interval B1 is calculated based on third control data. The first control data contains a second period and a conveyance speed of the following sheet P1. The second period represents a period of time between the start of energization to the solenoid 74 and the detection of the end of rotation of the second sheet feed roller R4. The process then proceeds to Step S206.

Step S206: the controller 40 determines whether or not the first interval B1 based on the third control data is greater than or equal to the fourth interval B4. When the controller 40 determines that the first interval B1 based on the third control data is greater than or equal to the fourth interval B4 (Step S206; Yes), the process proceeds to Step S207. When the controller 40 determines that the first interval B1 based on the third control data is not greater than or equal to the fourth interval B4 (Step S206; No), the process returns to Step S206. That is, the controller 40 determines that the first interval B1 based on the third control data is not greater than or equal to the fourth interval B4, and then calculates the first interval B1 based on the first control data. The conveyance of the following sheet P1 remains stopped until the controller 40 determines that the first interval B1 based on the first control data is greater than or equal to the fourth interval B4.

Step S207: the controller 40 performs control so that the second sheet feed roller group and the intermediate roller pair R6 are driven. The controller 40 performs control so that the second sheet feed roller group and the intermediate roller pair R6 are driven, thereby conveying the following sheet P1 to the registration roller pair R7. The process then ends.

Hereinafter, the process executed by the controller 40 will further be described with reference to FIGS. 1 to 3, 7A and 7B. Each of FIGS. 7A and 7B is a schematic diagram depicting how each sheet P is conveyed from the manual feed tray 22 in the present embodiment.

Figure 7A:
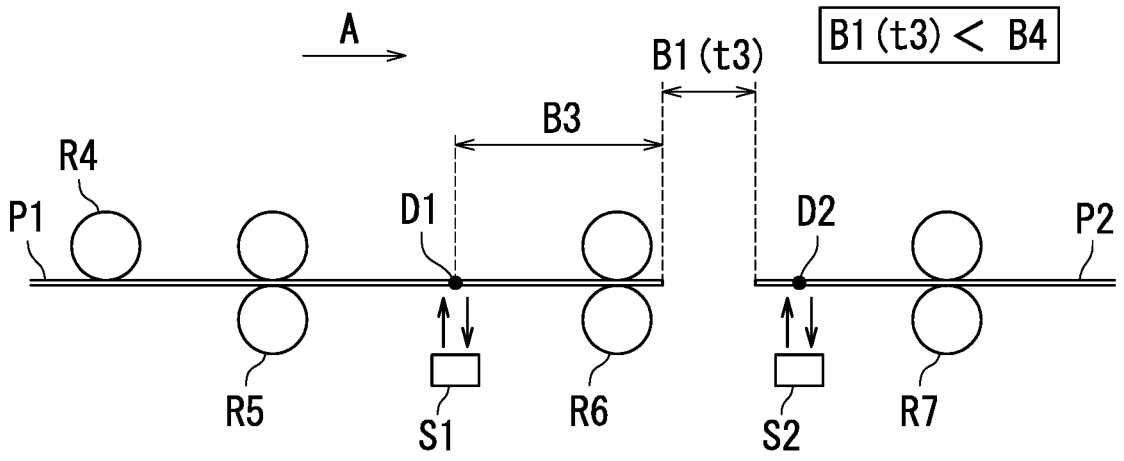
FIGS. 7A and 7B are schematic diagrams depicting how sheets are conveyed from a manual feed tray according to the embodiment of the present disclosure.

Specifically, FIG. 7A illustrates a conveyance state of the following sheet P1 and the leading sheet P2 at time t3. Time t3 represents a point in time of detection of the end of rotation of the second sheet feed roller R4 by the controller 40. In FIG. 7A, a first interval B1(t3) represents a first interval B1 based on the third control data at time t3.

As illustrated in FIG. 7A, the controller 40 determines that the first interval B1 based on the third control data is not greater than or equal to the fourth interval B4 at a point in time when the end of rotation of the second sheet feed roller R4 is detected. The controller 40 then performs control so that the drive of intermediate roller pair R6 is stopped. Note that the following sheet P1 is conveyed in the conveyance direction A during a period between the start of energization to the solenoid 74 by the controller 40 and time t3. The leading edge of the following sheet P1 is therefore positioned downstream of the intermediate roller pair R6 in the conveyance direction A at time t3. At time t3, the conveyance of the following sheet P1 is stopped, while the leading sheet P2 is conveyed in the conveyance direction A.

Figure 7B:
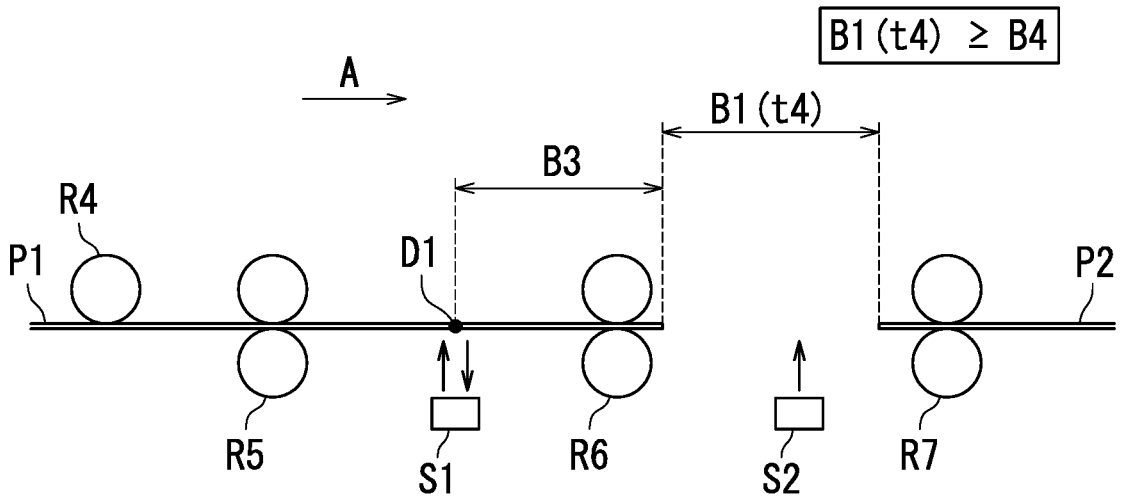

FIG. 7B illustrates a conveyance state of the following sheet P1 and the leading sheet P2 at time t4. Time t4 represents the start time of both the drive of the second sheet feed roller R4 and the drive of the intermediate roller pair R6 by the controller 40 after time t3. In FIG. 7B, a first interval B1(t4) represents a first interval B1 based on the third control data at time t4.

As illustrated in FIG. 7A, the controller 40 determines that the first interval B1(t4) based on the third control data is greater than or equal to the fourth interval B4, and then starts performing control so that the second sheet feed roller R4 and the intermediate roller pair R6 are driven. The following sheet P1 and the leading sheet P2 are consequently conveyed in the conveyance direction A.

As described above with reference to FIGS. 1 to 3, 6, 7A, and 7B, the controller 40 calculates the first interval B1 between the trailing edge of the leading sheet P2 and the leading edge of the following sheet P1 based on the output of the intermediate sensor S1. According to the first interval B1 calculated based on the output of the intermediate sensor S1, the controller 40 performs control so that the second sheet feed roller R4 and the intermediate roller pair R6 are driven. The sheet interval between the leading sheet P2 and the following sheet P1 is accordingly adjusted. The occurrence of a paper jam is consequently suppressed even if feed timing of the following sheet P1 from the manual feed tray 22 to the second conveyance path 36 is advanced in order to increase the number of prints per unit time by the image forming apparatus 100.

The controller 40 determines that the first interval B1 based on the output of the intermediate sensor S1 is not greater than or equal to the fourth interval B4, thereby performing control so that both drive of the second sheet feed roller group and drive of the intermediate roller pair R6 are stopped. That is, when the controller 40 determines that the first interval B1 based on the output of the intermediate sensor S1 is greater than or equal to the fourth interval B4, the following sheet P1 is conveyed to the registration roller pair R7 with the sheet interval between the leading sheet P2 and the following sheet P1 not adjusted.

The controller 40 determines that the first interval B1 based on the output of the intermediate sensor S1 is not greater than or equal to the fourth interval B4, thereby performing control so that the conveyance of the following sheet P1 is stopped. The controller 40 subsequently performs control so that the second sheet feed roller R4 and the intermediate roller pair R6 are driven until the interval between the trailing edge of the leading sheet P2 and the leading edge of the following sheet P1 reaches at least the fourth interval B4. That is, the sheet interval between the leading sheet P2 and the following sheet P1 is adjusted to be greater than or equal to the fourth interval B4. The occurrence of a paper jam is therefore suppressed. As a result, this configuration enables an increase in the number of prints per unit time by the image forming apparatus 100.

The image forming apparatus 100 includes a driving source 71 and a solenoid 74. The driving source 71 generates driving force for driving a second sheet feed roller R4. The solenoid 74 allows the driving force of the driving source 71 to be transmitted to the second sheet feed roller R4. A controller 40 detects an end of rotation of the second sheet feed roller R4. The controller 40 then calculates a third interval B3. The third interval B3 represents a distance between a position of a leading edge of a following sheet P1 and a position of an intermediate sensor S1. The controller 40 then acquires a fourth interval B4 by subtracting the third interval B3 from a second interval B2. The controller 40 employs the fourth interval B4 as the second interval B2. The sheet interval between the leading sheet P2 and the following sheet P1 is accordingly greater than or equal to the second interval B2. The occurrence of a paper jam is therefore suppressed even if the solenoid 74 is used for driving a sheet feed roller. That is, this configuration enables an increase in the number of prints per unit time regardless of a roller drive system.

The embodiment of the present disclosure has so far been described with reference to the accompanying drawings (FIGS. 1 to 7B). However, the present disclosure is not limited to the above embodiment and may be implemented in various manners within a scope not departing from the gist of the present disclosure (see (1) or (2) below, for example). The drawings schematically illustrate main elements of configuration to facilitate understanding thereof. Aspects of the elements of configuration illustrated in the drawings, such as thickness, length, and number, may differ in practice for the sake of convenience for drawing preparation. Furthermore, aspects of the elements of configuration illustrated in the above embodiment, such as material, shape, and dimension, are examples and are not particularly limited. The elements of configuration may be variously altered within a scope not substantially departing from the configuration of the present disclosure.

(1) Although the image forming apparatus 100 is the multifunction peripheral in the embodiment of the present disclosure, the image forming apparatus 100 is not limited to the multifunction peripheral. Examples of the image forming apparatus 100 may include a printer, a facsimile machine, and a multifunction peripheral with respective functions of the printer and the facsimile machine.

(2) Although the image forming apparatus 100 is provided with no conveyance roller between the intermediate roller pair R6 and the registration roller pair R7, the image forming apparatus 100 is not limited to this. The image forming apparatus 100 may further include a conveyance roller between the intermediate roller pair R6 and the registration roller pair R7.

What is claimed is:

1. An image forming apparatus that conveys sheets in a conveyance direction along a conveyance path to form an image on each of the sheets, comprising:

a sheet feed section that allows the sheets to be loaded therein;

a sheet feed roller configured to feed each of the sheets from the sheet feed section to the conveyance path;

an intermediate roller pair that is provided downstream of the sheet feed roller in the conveyance direction and configured to convey each of the sheets downstream of the conveyance direction;

an intermediate sensor that is provided upstream of the intermediate roller pair in the conveyance direction and configured to detect each of the sheets conveyed to the intermediate roller pair; and a controller configured to perform control so that the sheet feed roller and the intermediate roller pair are driven, wherein the sheets include a leading sheet and a following sheet, the sheet feed roller feeds the leading sheet and feeds the following sheet just after the leading sheet, and the controller calculates a first interval between a trailing edge of the leading sheet and a leading edge of the following sheet based on an output of the intermediate sensor, and according to the first interval, performs control so that the sheet feed roller and the intermediate roller pair are driven.

2. The image forming apparatus according to claim 1, wherein the controller performs control so that the intermediate roller pair is driven, with a result that the controller determines that the first interval is greater than or equal to a predefined second interval.

3. The image forming apparatus according to claim 2, wherein with a result that the controller determines that the first interval is not greater than or equal to the second interval, the controller performs control so that drive of the sheet feed roller is temporarily stopped and subsequently performs control so that the sheet feed roller and the intermediate roller pair are driven.

4. The image forming apparatus according to claim 3, wherein with a result that the controller determines that the first interval is not greater than or equal to the second interval, the controller performs control so that the drive of the sheet feed roller is temporarily stopped, and subsequently performs control so that the sheet feed roller and the intermediate roller pair are driven until an interval between the trailing edge of the leading sheet and the leading edge of the following sheet reaches at least the second interval.

5. The image forming apparatus according to claim 2, further comprising:

a driving source configured to generate driving force for driving the sheet feed roller; and a solenoid configured to transmit the driving force to the sheet feed roller to rotate the sheet feed roller, wherein the controller detects an end of rotation of the sheet feed roller after the following sheet is fed, calculates a third interval between a position of the leading edge of the following sheet and a position of the intermediate sensor, acquires a fourth interval by subtracting the third interval from the second interval, and employs the fourth interval as the second interval.

6. The image forming apparatus according to claim 1, further comprising:

an image forming section configured to form an image on each of the sheets; and a registration roller pair that is provided upstream of the image forming section in the conveyance direction and configured to adjust timing at which each of the sheets is conveyed to the image forming section.

7. An image forming method, comprising:

causing a sheet feed roller to feed a leading sheet to a conveyance path and subsequently causing the sheet feed roller to feed a following sheet to the conveyance path;

calculating a first interval between a trailing edge of the leading sheet conveyed by an intermediate roller pair and a leading edge of the following sheet conveyed to the intermediate roller pair just after the leading sheet; and performing control, according to the first interval, so that the sheet feed roller and the intermediate roller pair are driven.

* * * * *